US008493133B2

(12) United States Patent
Byeon

(10) Patent No.: US 8,493,133 B2
(45) Date of Patent: Jul. 23, 2013

(54) SEMICONDUCTOR MEMORY APPARATUS

(75) Inventor: Sang-Jin Byeon, Gyeonggi-do (KR)

(73) Assignee: Hynix Semiconductor Inc., Gyeonggi-do (KR)

( * ) Notice: Subject to any disclaimer, the term of this patent is extended or adjusted under 35 U.S.C. 154(b) by 156 days.

(21) Appl. No.: 12/495,005

(22) Filed: Jun. 30, 2009

(65) Prior Publication Data

US 2010/0289556 A1 Nov. 18, 2010

(30) Foreign Application Priority Data

May 15, 2009 (KR) ..... 10-2009-0042603

(51) Int. Cl.
*G05F 1/10* (2006.01)
*G05F 3/02* (2006.01)

(52) U.S. Cl.
USPC ..... 327/536; 327/537

(58) Field of Classification Search
USPC ..... 327/143, 157, 530, 534–537, 539–543
See application file for complete search history.

(56) References Cited

U.S. PATENT DOCUMENTS

| | | | | |
|---|---|---|---|---|
| 6,597,603 | B2 | 7/2003 | Lambrache et al. | |
| 7,075,853 | B2 | 7/2006 | Jeong et al. | |
| 2005/0141319 | A1 | 6/2005 | Jang | |
| 2006/0158264 | A1* | 7/2006 | Kousai et al. | 331/16 |
| 2006/0273844 | A1 | 12/2006 | Lee | |
| 2008/0024198 | A1* | 1/2008 | Bitonti et al. | 327/536 |

FOREIGN PATENT DOCUMENTS

| | | |
|---|---|---|
| JP | 2003-091991 | 3/2003 |
| JP | 2003-272396 | 9/2003 |
| KR | 1020090036453 | 4/2009 |

* cited by examiner

*Primary Examiner* — Lincoln Donovan
*Assistant Examiner* — Diana J Cheng
(74) *Attorney, Agent, or Firm* — Venable LLP; Jeffri A. Kaminski

(57) ABSTRACT

A semiconductor memory apparatus that generates a voltage by performing a pumping operation in response to an oscillator signal includes a driving voltage detecting unit configured to control the cycle of the oscillator signal in accordance with the level of a driving voltage that is used to perform the pumping operation.

24 Claims, 5 Drawing Sheets

SEMICONDUCTOR MEMORY APPARATUS

CROSS-REFERENCES TO RELATED PATENT APPLICATION

The present application claims priority under 35 U.S.C 119(a) to Korean Application No. 10-2009-0042603, filed on May 15, 2009, in the Korean Intellectual Property Office, which is incorporated herein by reference in its entirety as set forth in full.

BACKGROUND

1. Technical Field

The embodiment described herein relates to a semiconductor integrated circuit, and more particularly, a semiconductor memory apparatus that generates a pumping voltage and a bulk voltage.

2. Related Art

In general, semiconductor memory apparatuses are supplied with an external voltage and generate an internal voltage. In the internal voltages generated by semiconductor memory apparatus, a voltage, which has higher level than the external voltage, is called a pumping voltage, and a voltage that has lower level than a ground voltage is called a bulk bias voltage (hereafter, referred to as 'bulk voltage').

A convention semiconductor memory apparatus that generates the pumping voltage 'VPP' and the bulk voltage 'VBB', as shown in FIG. 1, is configured to include a pumping voltage detecting unit 10, a pumping oscillator 20, a pumping charge pump 30, a bulk voltage detecting unit 40, a bulk oscillator 50, and a bulk charge pump 60. In this configuration, the pumping voltage detecting unit 10, the pumping oscillator 20, the pumping charge pump 30, the bulk voltage detecting unit 40, the bulk oscillator 50, and the bulk charge pump 60 are supplied with an external voltage as a driving voltage.

The pumping voltage detecting unit 10 detects a pumping voltage 'VPP' and generates a pumping detection signal 'VPP_det'.

The pumping oscillator 20 generates a pumping oscillator signal 'VPP_osc' in response to the pumping detection signal 'VPP_det'.

The pumping charge pump 30 generates the pumping voltage 'VPP' by performing a pumping operation in response to the pumping oscillator signal 'VPP_osc'.

The bulk voltage detecting unit 40 detects a bulk voltage 'VBB' and generates a bulk detection signal 'VBB_det'.

The bulk oscillator 50 generates a bulk oscillator signal 'VBB_osc' in response to the bulk detection signal 'VBB_det'.

The bulk charge pump 60 generates the bulk voltage 'VBB' by performing a pumping operation in response to the bulk oscillator signal 'VBB_osc'.

Meanwhile, as the external voltage level increases, the pumping voltage 'VPP' increases in voltage level by an increase range larger than a predetermined voltage increase range when one pumping operation is performed, while the bulk voltage 'VBB' decreases in voltage level by a decrease range larger than a predetermined voltage decrease range. That is, as the external voltage level increases, the number of times of pumping at which the pumping voltage 'VPP' and the bulk voltage 'VBB' can reach a target level decreases. As a result, as the external voltage level increases, pumping efficiency increases, but unnecessary consumption of electric current is caused when a driving ability for the voltages 'VPP', 'VBB' generated by the pumping operation exceed a predetermined driving ability.

On the other hand, as an external voltage level decreases, the pumping voltage 'VPP' increases in voltage level by an increase range smaller than a predetermined voltage increase range when one pumping operation is performed, while the bulk voltage 'VBB' decreases in voltage level by a decrease range smaller than a predetermined voltage decrease range. That is, as the external voltage level decreases, the number of times of pumping at which the pumping voltage 'VPP' and the bulk voltage 'VBB' can reach a target level increases. As a result, as the external voltage level decreases, pumping efficiency is reduced and the voltages 'VPP', 'VBB' generated by the pumping operation cannot reach a predetermined driving ability.

SUMMARY

A semiconductor memory apparatus capable of performing a pumping operation by controlling the cycle of an oscillator signal in accordance with the level of an external voltage is described herein.

According to an embodiment, a semiconductor memory apparatus generates a voltage by performing a pumping operation in response to an oscillator signal, which includes a driving voltage detecting unit configured to control the cycle of the oscillator signal in accordance with the level of a driving voltage that is used to perform the pumping operation.

According to another embodiment a semiconductor memory apparatus includes: a driving voltage detecting unit configured to generate a plurality of driving detection signals by comparing the levels of a driving voltage and a reference voltage; an oscillator signal generating unit configured to generate the oscillator signal in accordance with the level of a voltage that is generated by a pumping operation, and to control the cycle of the oscillator signal in response to the plurality of driving detection signals; and a charge pump configured to generate the voltage by performing the pumping operation in response to the oscillator signal, in which the oscillator signal generating unit and the charge pump are operated by receiving the driving voltage.

According to another embodiment, a semiconductor memory apparatus generates a voltage by performing a pumping operation, in which whether to perform the pumping operation is determined in accordance with the level of a voltage generated by performing the pumping operation, and the number of times of the pumping operation that is performed for a predetermined time is controlled in accordance with the level of a driving voltage used to perform the pumping operation.

According to another embodiment, a semiconductor memory apparatus includes: a pumping oscillator signal generating unit configured to detect a pumping voltage and generate a pumping oscillator signal, and to control the cycle of the pumping oscillator signal in response to a plurality of driving detection signals; a bulk oscillator signal generating unit configured to detect a bulk voltage and generate a bulk oscillator signal, and to control the cycle of the bulk oscillator signal in response to the plurality of driving detection signals; a driving voltage detecting unit configured to generate the plurality of driving detection signals in accordance with the level of a driving voltage; a pumping charge pump configured to generate the pumping voltage in response to the pumping oscillator signal; and a bulk charge pump configured to generate the bulk voltage in response to the bulk oscillator signal.

According to another embodiment, a semiconductor memory apparatus includes: a pumping voltage generating unit configured to generate a pumping voltage by performing a pumping operation; a bulk voltage generating unit configured to generate a bulk voltage by performing a pumping operation; and a driving voltage detecting unit configured to control the number of times of pumping of the pumping voltage generating unit and the number of times of pumping of the bulk voltage generating unit, in accordance with the level of an external voltage that is used as a driving voltage of the pumping voltage generating unit and the bulk voltage generating unit.

These and other features, aspects, and embodiments are described below in the "Detailed Description."

BRIEF DESCRIPTION OF THE DRAWINGS

Features, aspects, and embodiments are described in conjunction with the attached drawings, in which.

DETAILED DESCRIPTION

Hereinafter, preferred embodiments will be described in detail with reference to the accompanying drawings.

Figure 2:
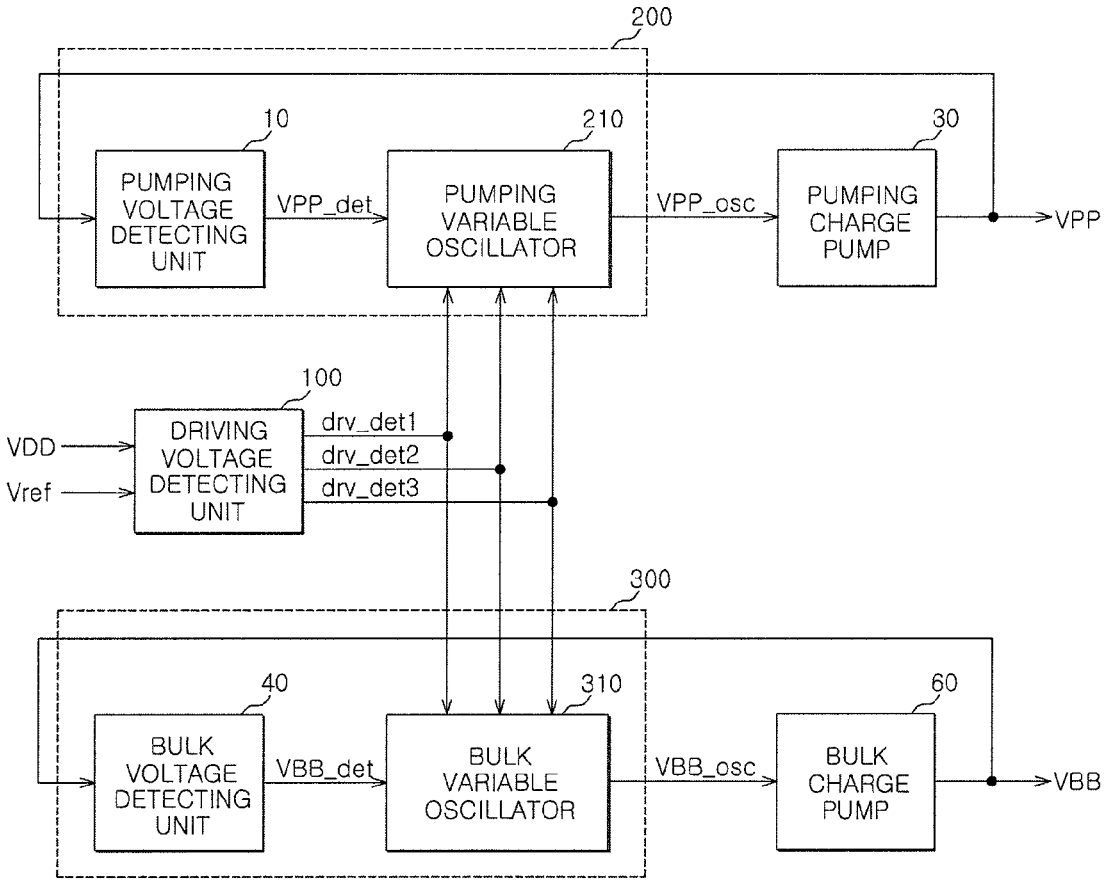
FIG. 2 is a diagram schematically illustrating an embodiment.

A semiconductor memory apparatus according to an embodiment, as shown in FIG. 2, is configured to include a driving voltage detecting unit 100, a pumping oscillator signal generating unit 200, a pumping charge pump 30, a bulk oscillator signal generating unit 300, and a bulk charge pump 60. In this configuration, the pumping oscillator signal generating unit 200, the pumping charge pump 30, the bulk oscillator signal generating unit 300, and the bulk charge pump 60 are supplied with an external voltage 'VDD' as a driving voltage.

The driving voltage detecting unit 100 detects the level of the external voltage 'VDD' that is used as a driving voltage in the pumping oscillator signal generating unit 200, pumping charge pump 30, bulk oscillator signal generating unit 300, and bulk charge pump 60, and generates first to third driving detection signals 'drv_det1' to 'drv_det3'.

The driving voltage detecting unit 100 sequentially enables the first to the third driving detection signals 'drv_det1' to 'drv_det3', when the level of the external voltage 'VDD' increases. That is, the higher the level of the external voltage 'VDD', the more the number of the driving detection signals 'drv_det1' to 'drv_det3' enabled by the driving voltage detecting unit 100 increases.

Figure 3:
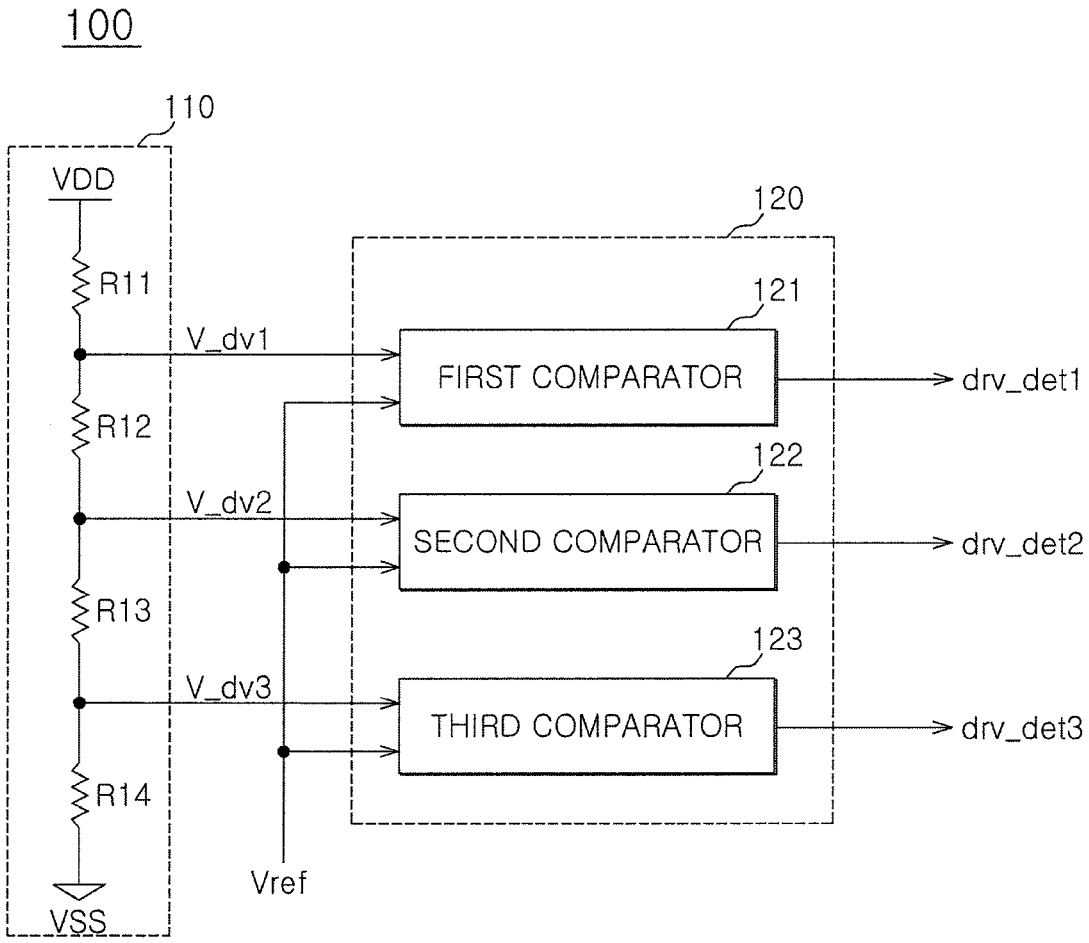
FIG. 3 is a diagram illustrating the driving voltage detecting unit of FIG. 2.

The driving voltage detecting unit 100, as shown in FIG. 3, can include a voltage dividing unit 110 and a comparing unit 120.

The voltage dividing unit 110 generates first to third divided voltages 'V_dv1' to 'V_dv3' by dividing the external voltage 'VDD'. The first to third divided voltages 'V_dv1' to 'V_dv3' are generated by dividing the external voltage 'VDD' with different voltage division ratios, such that the voltage levels are different. For example, it is possible to set the voltage level of the first divided voltage 'V_dv1' to be the highest, the voltage level of the second divided voltage 'V_dv2' to be the second highest, and the voltage level of the third divided voltage 'V_dv3' to be the lowest.

The voltage dividing unit 110 is configured to include first to fourth resistance elements 'R11' to 'R14' connected in a series, and an external voltage 'VDD' and a ground voltage 'VSS' are applied respectively to each ends of the first to fourth resistance elements 'R11' to 'R14' connected in a series. The first divided voltage 'V_dv1' is outputted from a node connecting the first resistance element 'R11' with the second resistance element 'R12'. The second divided voltage 'V_dv2' is outputted from a node connecting the second resistance element 'R12' with the third resistance element 'R13'. The third divided voltage 'V_dv3' is outputted from a node connecting the third resistance element 'R13' with the fourth resistance element 'R14'.

The comparing unit 120 generates the first to third driving detection signals 'drv_det1' to 'drv_det3' by comparing the levels of the first to third divided voltages 'V_dv1' to 'V_dv3' and a reference voltage 'Vref'.

The comparing unit 120 is configured to include first to third comparators 121 to 123.

The first comparator 121 generates the first driving detection signal 'drv_det1' by comparing the levels of the first divided voltage 'V_dv1' and the reference voltage 'Vref'. The second comparator 122 generates the second driving detection signal 'drv_det2' by comparing the levels of the second divided voltage 'V_dv2' and the reference voltage 'Vref'. The third comparator 123 generates the third driving detection signal 'drv_det3' by comparing the levels of the third divided voltage 'V_dv3' and the reference voltage 'Vref'.

In FIG. 2, the pumping oscillator signal generating unit 200 detects the level of a pumping voltage 'VPP' and generates a pumping oscillator signal 'VPP_osc' and controls the cycle of the pumping oscillator signal 'VPP_osc' in response to the first to third driving detection signals 'drv_det1' to 'drv_det3'.

The pumping oscillator signal generating unit 200, as shown in FIG. 2, is configured to include a pumping voltage detecting unit 10 and a pumping variable oscillator 210.

Figure 1:
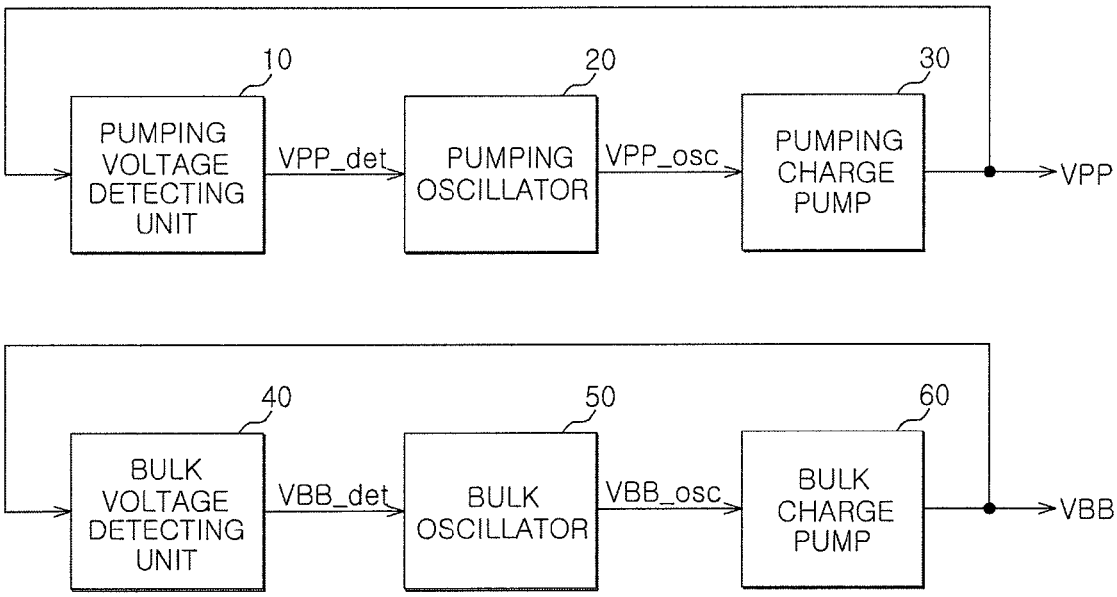
FIG.1 (PRIOR ART)
FIG. 1 is a diagram illustrating the configuration of a conventional semiconductor memory apparatus.

The pumping voltage detecting unit 10 detects the level of the pumping voltage 'VPP' and generates a pumping detection signal 'VPP_det'. The pumping voltage detecting unit 10 can be configured the same as the pumping voltage detecting unit 10 shown in FIG. 1.

The pumping variable oscillator 210 generates the pumping oscillator signal 'VPP_osc', when the pumping detection signal 'VPP_det' is enabled. The more the number of signals, which are enabled, in the first to third driving detection signals 'drv_det1' to 'drv_det3', the more the pumping variable oscillator 210 increases the cycle of the pumping oscillator signal 'VPP_osc'.

Figure 4:
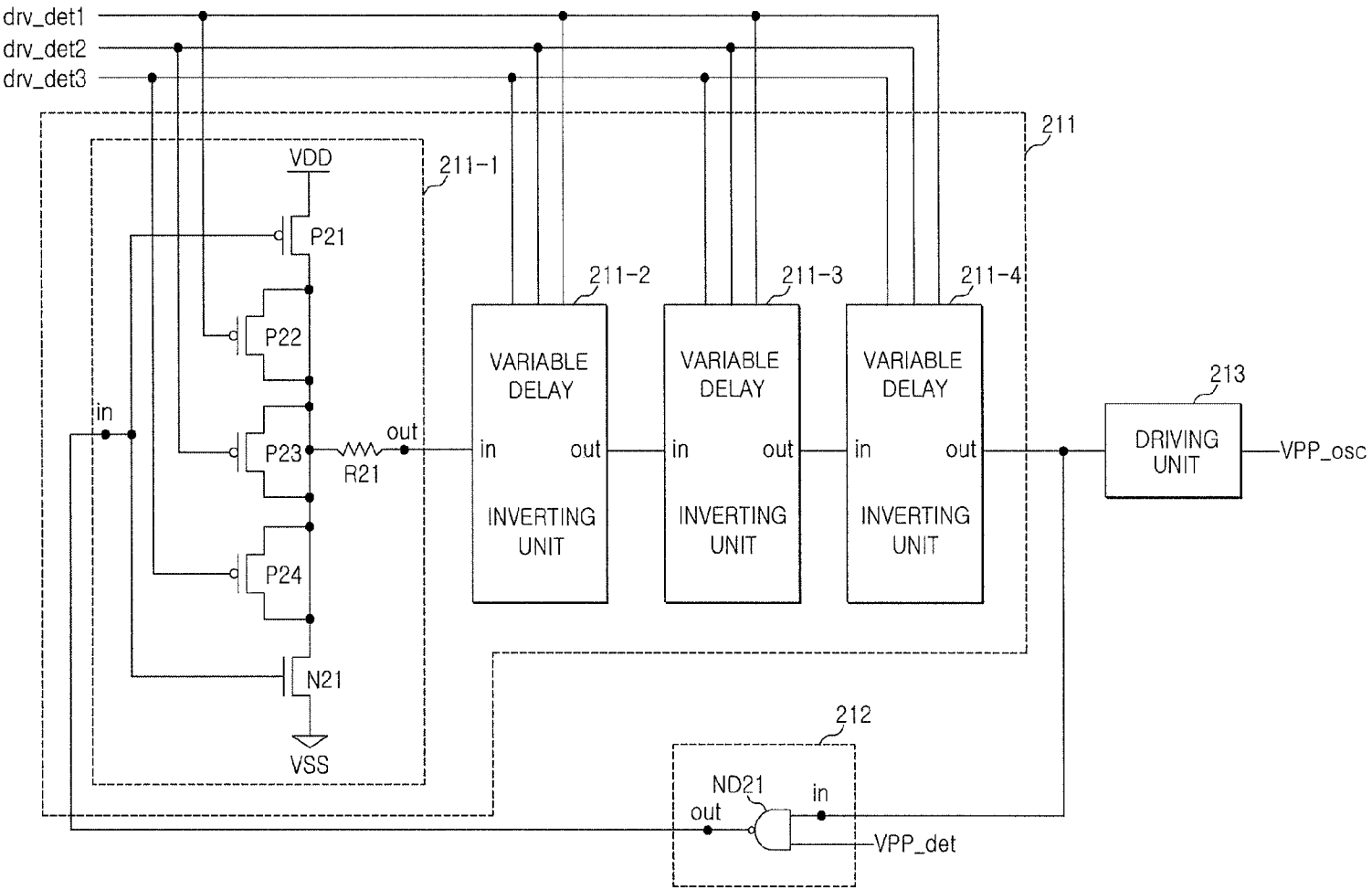
FIG. 4 is a diagram illustrating the pumping variable oscillator of FIG. 2.

The pumping variable oscillator 210, as shown in FIG. 4, is configured to include a delay unit 211, an oscillation control unit 212, and a driving unit 213.

The more the number of signals, which are enabled, in the first to third driving detection signals 'drv_det1' to 'drv_det3', the more delay unit 211 increases the delay time. Further, the delay unit 211 receives an output signal of the oscillation control unit 212 and delays the output signal for the delay time, and then outputs the delayed output signal as an input signal of the oscillation control unit 212.

The delay unit 211 is configured to include first to fourth variable delay inverting units 211-1 to 211-4 connected in a series.

The more the number of signals, which are enabled, in the first to third driving detection signals 'drv_det1' to 'drv_det3', the more the first to fourth variable inverting units 211-1 to 211-4 each delay an input signal by increasing the delay time, and invert and output the input signal which is delayed and inverted.

The first to fourth variable inverting units 211-1 to 211-4 can be configured to have the same configuration and only the configuration of the first variable inverting unit 211-1 is shown in FIG. 4.

The first variable delay unit 211-1 is configured to include first to fifth transistors 'P21', 'N21', 'P22' to 'P24', and a fifth resistance element 'R21'. The first transistor 'P21' is connected with an input terminal 'in' through a gate and receives an external voltage 'VDD' through a source. The second transistor 'N21' is connected with the input terminal 'in' through a gate, connected with a drain of the first transistor 'P21' through a drain, and connected with a ground terminal 'VSS' through a source. The third transistor P22 receives the first driving detection signal 'drv_det1' through a gate and is connected with a node, which connects the first transistor 'P21' and the second transistor 'N21', through a drain and a source. The fourth transistor 'P23' receives the second driving detection signal 'drv_det2' through a gate and is connected with the node, which connects the first transistor 'P21' with the second transistor 'N21', through a drain and a source. The fifth transistor P24 receives the third driving detection signal 'drv_det3' through a gate and is connected with the node, which connects the first transistor 'P21' with a second transistor 'N21', through a drain and a source. The fifth resistance element 'R21' is connected with the node, which connects the first transistor 'P21' with the second transistor 'N21', through one end, and the other end of the fifth resistance element 'R21' is an output terminal of the first variable delay inverting unit 211-1.

Figure 5:
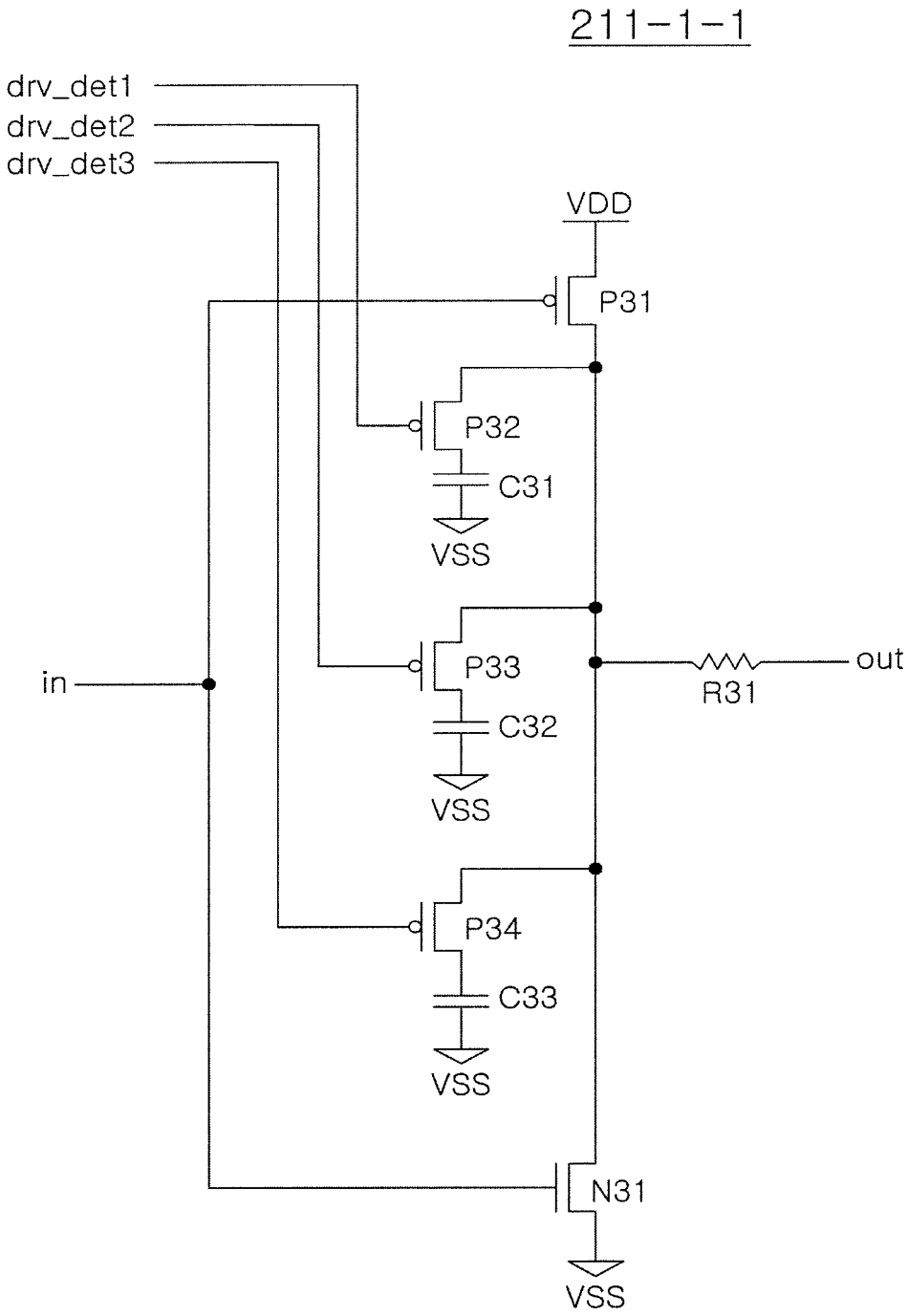
FIG. 5 is a diagram illustrating another embodiment of the variable delay inverting unit of FIG. 4.

Further, the first variable delay inverting unit 211-1-1, as shown in FIG. 5, can be composed of sixth to tenth transistors 'P31', 'N31', 'P32' to 'P34', first the third capacitors 'C31' to 'C33', and a sixth resistance element 'R31'.

The sixth transistor 'P31' is connected with an input terminal 'in' through a gate and receives an external voltage 'VDD' through a source. The seventh transistor 'N31' is connected with the input terminal 'in' through a gate, connected with the drain of the sixth transistor 'P31' through a drain, and connected with a ground terminal 'VSS' through a source. The eighth transistor 'P32' receives the first driving detection signal 'drv_det1' through a gate and is connected with a node, which connects the sixth transistor 'P31' with the seventh transistor 'N31', through a source. The first capacitor 'C31' is connected with the drain of the eighth transistor 'P32' through one end and connected with a ground terminal 'VSS' through the other end. The ninth transistor 'P33' receives the second driving detection signal 'drv_det2' through a gate and is connected with the node, which connects the sixth transistor 'P31' with the seventh transistor 'N31', through a source. The second capacitor 'C32' is connected with the drain of the ninth transistor 'P33' through one end and connected with a ground terminal 'VSS' through the other end. The tenth transistor 'P34' receives the third driving detection signal 'drv_det3' through a gate and is connected with a node, which connects the sixth transistor 'P31' with the seventh transistor 'N31', through a source. The third capacitor 'C33' is connected with the drain of the tenth transistor 'P34' through one end and connected with a ground terminal 'VSS' through the other end.

In FIG. 4, the oscillation control unit 212 includes a NAND gate 'ND21', outputs a signal inputted from an input terminal 'in', that is, inverts the output signal of the delay unit 211 and then outputs the output signal to an output terminal 'out', when the pumping detection signal 'VPP_det' is enabled, and outputs only a high-level signal, regardless of the signal inputted from the input terminal 'in', when the pumping detection signal 'VPP_det' is disabled.

The driving unit 213 drives an output signal of the delay unit 211 and outputs the output signal as the pumping oscillator signal 'VPP_osc'.

The pumping charge pump 30, as shown in FIG. 2, generates the pumping voltage 'VPP' by performing a pumping operation in response to the pumping oscillator signal 'VPP_osc'. The pumping charge pump 30 can have the same configuration as the pumping charge pump 30 shown in FIG. 1.

The bulk oscillator signal generating unit 300, as shown in FIG. 2, detects the level of a bulk voltage 'VBB' and generates a bulk oscillator signal 'VBB_osc', and controls the cycle of the bulk oscillator signal 'VBB_osc' in response to the first to third driving detection signals 'drv_det1' to 'drv_det3'.

The bulk oscillator signal generating unit 300 is configured to include a bulk voltage detecting unit 40 and a bulk variable oscillator 310.

The bulk voltage detecting unit 40 detects the level of the bulk voltage 'VBB' and generates a bulk detection signal 'VBB_det'. The bulk voltage detecting unit 40 can be configured the same as the bulk voltage detecting unit 40 shown in FIG. 1.

The bulk variable oscillator 310 generates the bulk oscillator signal 'VBB_osc' in response to the bulk detection signal 'VBB_det', and the more the number of signals, which are enabled, in the first to third driving detection signals 'drv_det1' to 'drv_det3', the more the bulk variable oscillator 310 increases the cycle of the bulk oscillator signal 'VBB_osc.

The bulk variable oscillator 310, as shown in FIG. 4, can be configured the same as the pumping variable oscillator 210 shown in FIG. 4. However, the bulk variable oscillator 310 receives the bulk detection signal 'VBB_det' instead of the pumping detection signal 'VPP_det', and outputs the bulk oscillator signal 'VBB_osc' instead of the pumping oscillator signal 'VPP_osc'. Accordingly, the description of the configuration of the bulk variable oscillator 310 is replaced by the description of the configuration of the pumping variable oscillator 210.

The bulk charge pump 60 generates the bulk voltage 'VBB' by performing a pumping operation in response to the bulk variable oscillator signal 'VBB_osc'. The bulk charge pump 60 of FIG. 2, may be configured the same as the bulk charge pump 60 shown in FIG. 1.

A semiconductor memory apparatus having the above configuration according to an embodiment may operate as follows.

A circuit for generating the pumping voltage 'VPP' shown in FIG. 2, i.e. a pumping voltage generating unit includes the pumping oscillator signal generating unit 200 and the pumping charge pump 30, and a circuit for generating the bulk voltage 'VBB', i.e. a bulk voltage generating unit includes the bulk oscillator signal generating unit 300 and the bulk charge pump 60. The pumping voltage generating unit and the bulk voltage generating unit both receive an external voltage 'VDD' as a driving voltage.

As the level of the external voltage 'VDD' increases, the driving voltage detecting unit 100 sequentially enables the first to third driving detection signals 'drv_det1' to 'drv_det3'.

The pumping voltage detecting unit 10 detects the level of the pumping voltage 'VPP' and generates a pumping detection signal 'VPP_det'.

The pumping variable oscillator 210 generates a pumping oscillator signal 'VPP_osc', when the pumping detecting signal 'VPP_det' is enabled, and fixes the pumping oscillator signal 'VPP_osc' to a predetermined level, when the pumping detection signal 'VPP_det' is disabled. The more the number of signals, which are enabled, in the first to third driving detection signals 'drv_det1' to 'drv_det3', the more the pumping variable oscillator 210 increases the cycle of the pumping oscillator signal 'VPP_osc'.

The pumping charge pump 30 generates the pumping voltage 'VPP' by performing the pumping operation in response to the pumping oscillator signal 'VPP_osc'. However, the pumping charge pump 30 does not perform the pumping operation, when the pumping oscillator signal 'VPP_osc' is fixed to a predetermined level. In general, in the pumping charge pump 30, the number of times of pumping operation that is performed for a predetermined time is determined in accordance with the cycle of the pumping oscillator signal 'VPP_osc'. For example, when the cycle of the pumping oscillator signal 'VPP_osc' becomes long, the number of times of the pumping operation that is performed for a predetermined time decreases, as compared with when the cycle is short.

As a result, since the number of times of the pumping operation for generating the pumping voltage 'VPP' decreases, when the level of the external voltage 'VDD' increases, the driving ability for the pumping voltage 'VPP' does not exceed a predetermined driving ability. Therefore, when a semiconductor memory apparatus according to an embodiment generates a pumping voltage 'VPP', the driving ability for the pumping voltage 'VPP' does not exceed a predetermined driving ability, such that it is possible to reduce electric current consumption.

The bulk voltage detecting unit 40 detects a bulk voltage 'VBB' and generates a bulk detecting signal 'VBB_det'.

The bulk variable oscillator 310 generates a bulk oscillator signal 'VBB_osc', when the bulk detection signal 'VBB_det' is enabled, and fixes the bulk oscillator signal 'VBB_osc' to a predetermined level, when the bulk detection signal 'VBB_det' is disabled. The more the number of signals, which are enabled, in the first to third driving detection signals 'drv_det1' to 'drv_det3', the more the bulk variable oscillator 310 increases the cycle of the bulk oscillator signal 'VBB_osc'.

The bulk charge pump 60 generates the bulk voltage 'VBB' by performing a pumping operation in response to the bulk oscillator signal 'VBB_osc'. The bulk charge pump 60 stops the pumping operation, when the bulk oscillator signal 'VBB_osc' is fixed to a predetermined level.

In general, in the bulk charge pump 60, the number of times of the pumping operation that is performed for a predetermined time is determined in accordance with the cycle of the bulk oscillator signal 'VBB_osc'. For example, when the cycle of the bulk oscillator signal 'VBB_osc' becomes long, the number of times of the pumping operation that is performed for a predetermined time decreases, as compared with when the cycle is short.

As a result, since the number of times of the pumping operation for generating the bulk voltage 'VBB' decreases, when the level of the external voltage 'VDD' increases, the driving ability for the bulk voltage 'VBB' does not exceed a predetermined driving ability. Therefore, when a semiconductor memory apparatus according to an embodiment generates a bulk voltage 'VBB', the driving ability for the pumping voltage 'VBB' does not exceed a predetermined driving ability, such that it is possible to reduce electric current consumption.

Since a semiconductor memory apparatus according to an embodiment adjusts the driving ability for a voltage generated by a pumping operation by controlling a circuit, which generates a voltage by performing a pumping operation in accordance with the level of a driving voltage used for performing the pumping voltage (i.e. the cycle of an oscillator signal that is used to perform the pumping operation), or the number of times of the pumping operation, it is possible to efficiently control the efficiency of the pumping operation and the amount of electric current consumption.

While certain embodiments have been described above, it will be understood that the embodiments described are by way of example only. Accordingly, the device and method described herein should not be limited based on the described embodiments. Rather, the devices and methods described herein should only be limited in light of the claims that follow when taken in conjunction with the above description and accompanying drawings.

What is claimed is:

1. A semiconductor memory apparatus that generates a pumping voltage by performing a pumping operation in response to an oscillator signal, the semiconductor memory apparatus comprising:

a pumping voltage detecting unit configured to generate a detection signal by detecting a level of the pumping voltage;

a variable oscillator configured to generate the oscillator signal in response to the detection signal and to control a cycle of the oscillator signal in response to a plurality of driving detection signals; and a driving voltage detecting unit configured to compare an external power supply voltage with a reference voltage to generate the plurality of driving detection signals and control the cycle of the oscillator signal in response to the plurality of the driving detection signals.

2. The semiconductor memory apparatus according to claim 1, wherein as the level of the external power supply voltage increases, the driving voltage detecting unit increases a number of enabled driving detection signals such that the cycle of the oscillator signal increases.

3. The semiconductor memory apparatus according to claim 2, wherein the driving signal detecting unit comprises:

a voltage dividing unit configured to generate a plurality of divided voltages by dividing the external power supply voltage; and a comparing unit configured to generate the plurality of driving detection signals by comparing levels of each of the plurality of divided voltages and the reference voltage.

4. The semiconductor memory apparatus according to claim 3, wherein the voltage dividing unit generates the plurality of divided voltages having different levels by dividing the external power supply voltage with different division ratios.

5. The semiconductor memory apparatus according to claim 3, wherein the comparing unit comprises a plurality of comparators that outputs the driving detection signals by comparing the levels of each of the divided voltages with the reference voltage.

6. The semiconductor memory apparatus according to claim 1, further comprising:

a charge pump configured to generate the pumping voltage by performing the pumping operation in response to the oscillator signal.

7. The semiconductor memory apparatus according to claim 6, wherein the pumping voltage detecting unit enables the detection signal, when the level of the pumping voltage generated by the pumping operation does not reach a target level.

8. The semiconductor memory apparatus according to claim 6, wherein as a number of enabled driving detection signals increases, the variable oscillator increases the cycle of the oscillator signal.

9. The semiconductor memory apparatus according to claim 8, wherein the variable oscillator comprises:

variable delay inverting units of even-number configured to increase a delay time, as the number of enabled driving detection signals increases, and delay and invert an input signal for the delay time and then output the input signal which is delayed and inverted; and an oscillation control unit configured to invert and output an input signal, when the detection signal is enabled, and output a signal at a predetermined level, regardless of the input signal, when the detection signal is disabled, wherein the variable delay inverting units are connected in a series and configured that an output terminal of the oscillation control unit is coupled to a first input terminal of the variable delay inverting units and an output terminal of the variable delay inverting unit is connected to an input terminal of the oscillation control unit.

10. The semiconductor memory apparatus according to claim 9, wherein the variable oscillator further comprises a driving unit that drives and outputs a last output of the variable delay units as the oscillator signal.

11. A semiconductor memory apparatus, comprising:

a driving voltage detecting unit configured to generate a plurality of driving detection signals by comparing an external power supply voltage with a reference voltage;

an oscillator signal generating unit configured to generate an oscillator signal in accordance with a detection signal generated by detecting a level of a pumping voltage that is generated by a pumping operation, and to control a cycle of the oscillator signal in response to the plurality of driving detection signals; and a charge pump configured to generate the pumping voltage by performing the pumping operation in response to the oscillator signal, wherein the oscillator signal generating unit and the charge pump are operated by receiving the external power supply voltage.

12. The semiconductor memory apparatus according to claim 11, wherein as the level of the external power supply voltage increases, the driving voltage detecting unit increases a number of enabled driving detection signals such that the cycle of the oscillator signal increases.

13. The semiconductor memory apparatus according to claim 12, wherein the driving voltage detecting unit comprises:

a voltage dividing unit configured to generate a plurality of different divided voltages by dividing the external power supply voltage with different ratios; and a comparing unit configured to generate the plurality of driving detection signals by comparing each of the divided voltages with the reference voltage.

14. The semiconductor memory apparatus according to claim 13, wherein the comparing unit comprises a plurality of comparators configured to compare the divided voltages with the reference voltage.

15. The semiconductor memory apparatus according to claim 11, wherein the oscillator generating unit comprises:

a voltage detecting unit configured to generate a detection signal in accordance with the level of the pumping voltage generated by the pumping operation; and a variable oscillator configured to generate the oscillator signal, when the detection signal is enabled, and to increase the cycle of the oscillator signal, when the number of enabled driving detection signals increases.

16. The semiconductor memory apparatus according to claim 15, wherein the variable oscillator comprises:

a delay unit configured to increase in delay time, as the number of the driving detection signals increases; and an oscillation control unit configured to invert and output an input signal, when the detection signal is enabled, and output a signal only at a predetermined level, regardless of the input signal, when the detection signal is disabled, wherein an output terminal of the delay unit is connected to an input terminal of the oscillation control unit and an output terminal of the oscillation control unit is connected to an input terminal of the delay unit.

17. The semiconductor memory apparatus according to claim 16, wherein the delay unit comprises variable delay inverting units of even-number connected in a series, and each of the variable delay inverting units increases in delay time, delays its input signal for the delay time, and inverts and outputs the input signal which is delayed and inverted, when the number of enabled driving detection signals increases.

18. A semiconductor memory apparatus comprising:

a pumping voltage detecting unit configured to detect a pumping voltage and generate a detection signal; and a pumping variable oscillator configured to generate a pumping oscillator signal in response to the detection signal and control a cycle of the pumping oscillator signal in accordance with a number of enabled driving detection signals a bulk oscillator signal generating unit configured to detect a bulk voltage and generate a bulk oscillator signal, and control the cycle of the bulk oscillator signal in response to the plurality of the driving detection signals;

a driving voltage detecting unit configured to generate a plurality of divided voltages having different levels by dividing a external power supply voltage with different voltage division ratios, and generates the plurality of driving detection signals by comparing levels of each of the plurality of divided voltages and one reference voltage;

a pumping charge pump configured to generate the pumping voltage in response to the pumping oscillator signal; and a bulk charge pump configured to generate the bulk voltage in response to the bulk oscillator signal.

19. The semiconductor memory apparatus according to claim 18, wherein the pumping variable oscillator, the bulk oscillator signal generating unit, the pumping charge pump, and the bulk charge pump are operated to receive the external power supply voltage as a voltage source.

20. The semiconductor memory apparatus according to claim 18, wherein the pumping variable oscillator increases the cycle of the pumping oscillator signal, when the number of enabled driving detection signal increases.

21. The semiconductor memory apparatus according to claim 20, wherein the pumping variable oscillator comprises:

variable delay inverting units of even-number that are connected in a series, increase in delay time when the number of enabled driving detection signals increases, and delay an input signal for the delay time, and invert and output the input signal which is delayed and inverted; and an oscillation control unit that inverts and inputs an output of a last of the variable delay inverting units to a first of the variable delay inverting units, when the detection signal is enabled, and inputs a signal only at a predetermined level to the first variable delay inverting unit, regardless of the output of the last variable delay inverting unit, when the detection signal is disabled.

22. The semiconductor memory apparatus according to claim 18, wherein the driving voltage detecting unit comprises:

a voltage dividing unit configured to generate the plurality of divided voltages by dividing the external power supply voltage; and a plurality of comparators configured to compare the divided voltages with the reference voltage.

23. The semiconductor memory apparatus according to claim 18, wherein the bulk oscillator signal generating unit comprises:

a bulk voltage detecting unit configured to detect a level of the bulk voltage and generate a bulk detection signal; and a bulk variable oscillator configured to generate a bulk oscillator signal in response to the bulk detection signal, and increase a cycle of the bulk oscillator signal, as the number of enabled driving detection signals increases.

24. The semiconductor memory apparatus according to claim 23, wherein the bulk variable oscillator comprises:

a delay unit configured to increase in delay time, as the number of enabled driving detection signals increases; and an oscillation control unit configured to invert and output an output signal of the delay unit as an input signal of the delay unit, when the bulk detection signal is enabled, and to output a signal at a predetermined level as the input signal of the delay unit, regardless of the output signal of the delay unit, when the bulk detection signal is disabled.

* * * * *